US005211395A

United States Patent [19]

Liao

[11] Patent Number: 5,211,395

[45] Date of Patent: May 18, 1993

[54] GOLF TOOL

[76] Inventor: Henry H. Liao, 3091 Quail Run Rd., Los Alamitos, Calif. 90720

[21] Appl. No.: 765,203

[22] Filed: Sep. 25, 1991

[51] Int. Cl.[5] ..... A63B 57/00

[52] U.S. Cl. ..... 273/32 A; 273/33; 273/208

[58] Field of Search ..... 273/33, 32, 202-212; D21/208

[56] References Cited

U.S. PATENT DOCUMENTS

| | | | |
|---|---|---|---|
| D. 194,040 | 11/1962 | Schroeder . | |
| D. 203,604 | 2/1966 | Jacono . | |
| D. 223,723 | 5/1972 | Thompson . | |
| D. 225,756 | 1/1973 | Stephens . | |
| D. 233,452 | 10/1974 | Mayson . | |
| D. 239,123 | 3/1976 | Reed | D21/208 |
| D. 243,868 | 5/1977 | Williams, Jr. . | |
| D. 272,461 | 1/1984 | Burns . | |
| D. 300,160 | 5/1989 | Johnson . | |
| 1,410,483 | 3/1922 | Lard | 273/209 |
| 1,550,483 | 8/1925 | Wulkop | 273/208 |
| 1,629,981 | 5/1927 | Webster | 273/205 |
| 1,643,113 | 9/1927 | Clark | 273/33 |
| 2,519,727 | 8/1950 | Yezdan . | |
| 3,120,388 | 2/1964 | Doble . | |
| 3,203,700 | 8/1965 | Antonious . | |
| 3,406,977 | 10/1968 | Voelkerding | 273/202 |
| 3,409,987 | 11/1968 | New . | |
| 3,622,157 | 11/1971 | Hatch . | |
| 3,774,913 | 11/1973 | Dien | 273/32 A |
| 3,824,698 | 7/1974 | Brueker | 273/32 H |
| 3,907,288 | 9/1975 | Hudak . | |
| 4,007,928 | 2/1977 | Doubt | 273/32 B |
| 4,063,731 | 12/1977 | Kitay | 273/32 H |
| 4,114,878 | 9/1978 | Hammond | 273/32 A |
| 4,386,774 | 6/1983 | Buckman . | |
| 4,535,987 | 8/1985 | Dickoff | 273/32 A |
| 4,627,621 | 12/1986 | Tate | 273/32 B |
| 4,862,970 | 9/1989 | Hlavacek . | |
| 4,893,818 | 1/1990 | Liccardello . | |
| 4,925,190 | 5/1990 | Learned . | |
| 4,951,945 | 8/1990 | Gamble | 273/33 |
| 4,960,239 | 10/1990 | Wait . | |
| 4,974,842 | 12/1990 | Widman | 273/32 A |
| 5,022,650 | 6/1991 | Madock | 273/32 A |
| 5,033,747 | 7/1991 | Young | 273/208 |

FOREIGN PATENT DOCUMENTS

| | | | |
|---|---|---|---|
| 3537790 | 4/1987 | Fed. Rep. of Germany | 273/33 |

*Primary Examiner*—Theatrice Brown

*Attorney, Agent, or Firm*—Mason, Fenwick & Lawrence

[57] ABSTRACT

In a first embodiment, a golf tool comprises an upper tee portion including a tee cup, and a lower green repair portion including a body portion adjacent to the upper tee portion and a pair of prongs extending downwardly from said body portion. A ball marker is removably attached to the body portion. In a second embodiment, the inner edges of the prongs comprise a range-finder for determining the distance between a golfer holding the tool and a pin of known height, and a golf tee is attached to the tee portion by a cord. The golf tee and cord function to position the range-finder a predetermined distance from the eyes of the golfer. In a third embodiment, the golf tool comprises first, second, and third members, and cords respectively attaching the second and third members to the first member. The first member includes a body portion and a pair of prongs extending downwardly from the body portion, the inner edges of the prongs comprising a range-finder. The second and third members comprise golf tees of different heights. Each of the tees in combination with its cord functions to position the range-finder a predetermined distance from the eyes of the golfer. A ball marker can be removably attached to the body portion of the first member.

4 Claims, 2 Drawing Sheets

GOLF TOOL

BACKGROUND OF THE INVENTION

1. Field of the Invention

The present invention relates to tools for golfers, and more specifically, the invention relates to such tools which combine a golf tee, a green repair tool, and a ball marker, and optionally a range finder.

2. Related Art

There are two tools necessary to playing the game of golf which golfers typically carry in their pockets: a tee and a ball marker. Less frequently, golfers also carry in their pockets a ball mark repair or green tool for repairing the ball print on the putting green or the hole left by the ball marker. Because the green repair tool is relatively large and heavy in comparison to the tee and the ball marker, and is not actually necessary in playing golf, many golfers simply dispense with it. As a result, many golfers also dispense with the etiquette of repairing their ball marks.

In addition, it is cumbersome for the golfer to have to dig repeatedly into his or her pocket to retrieve the tee, then the ball marker, then the green repair tool. It is one object of the present invention to eliminate clutter in the golfer's pockets and encourage the use of the green repair tool by providing a golf tool which combines a golf tee, a green repair tool, and a ball marker, and optionally a range finder.

SUMMARY OF THE INVENTION

This and other objects of the invention are achieved by provision of a golf tool which comprises an upper tee portion including a tee cup, and a lower green repair portion including a body portion adjacent to the upper tee portion and a pair of prongs extending downwardly from said body portion. A ball marker is removably attached to the body portion.

In one aspect of the invention, the inner edges of the prongs comprise a range-finder for determining the distance between a golfer holding the tool and a pin of known height, and a golf tee is attached to the tee portion by a cord. The golf tee and cord function to position the range-finder a predetermined distance from the eyes of the golfer.

In another aspect of the invention, the golf tool comprises first, second, and third members, and cords respectively attaching the second and third members to the first member. The first member includes a body portion and a pair of prongs extending downwardly from the body portion, the inner edges of the prongs comprising a range-finder for determining the distance between a golfer holding the tool and a pin of known height. The second member comprises a first golf tee having a height appropriate for use with a driver. The third member comprises a second golf tee having a height appropriate for use with a club other than a driver. Each of the tees in combination with its cord functions to position the range-finder a predetermined distance from the eyes of the golfer. A ball marker can be removably attached to the body portion of the first member.

BRIEF DESCRIPTION OF THE DRAWINGS

The invention is better understood by reading the following Detailed Description of the Preferred Embodiments with reference to the accompanying drawing figures, in which like reference numerals refer to like elements throughout, and in which.

DETAILED DESCRIPTION OF THE PREFERRED EMBODIMENTS

Figure 1:
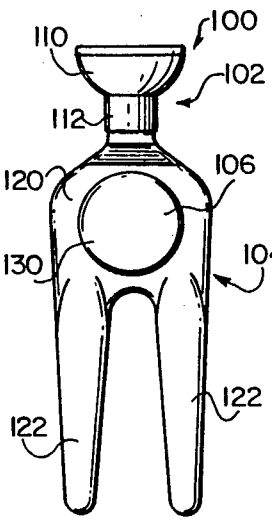
FIG. 1 is a front elevational view of a first embodiment of a golf tool in accordance with the invention.

In describing preferred embodiments of the present invention illustrated in the drawings, specific terminology is employed for the sake of clarity. However, the invention is not intended to be limited to the specific terminology so selected, and it is to be understood that each specific element includes all technical equivalents which operate in a similar manner to accomplish a similar purpose. For example, 'top," "bottom," "upper," "lower," and so forth, are presented for ease of reference in describing a particular embodiment, and do not limit the scope of the invention in any way.

Figure 2:
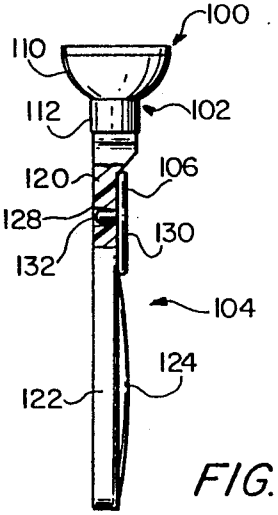
FIG. 2 is a side elevational view of the tool of FIG. 1, with parts broken away.
Figure 3:
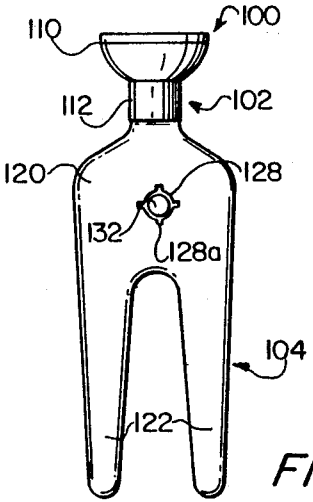
FIG. 3 is a rear elevational view of the tool of FIG. 1.

Referring now to FIGS. 1 through 3, there is shown a first embodiment of a golf tool 100 in accordance with the present invention. Tool 100 comprises an upper tee portion 102, a lower green repair portion 104, and a ball marker 106 removably incorporated into green repair portion 104.

Tee portion 102 comprises a conventional tee cup 110 for holding a golf ball, supported and connected to green repair portion 104 by a substantially cylindrical shaft 112.

Green repair portion 104 comprises an upper body portion 120 adjacent shaft 112 and a pair of tapered prongs or legs 122 extending downwardly from body portion 120. Prongs 122 are sufficiently tapered to enable tool 100 to be easily inserted into the ground, but sufficiently rounded to avoid injury to the golfer when being handled or when placed in a clothing pocket. Further, prongs 122 can be provided on one face with convex protrusions 124 to strengthen and reinforce them against breakage An aperture 128 is formed centrally in body portion 120 for a purpose to be described hereinafter. Aperture 128 is substantially circular in shape with a plurality of radial slits 128*a* extending outwardly therefrom, and tapers from one side of tool 100 to another as shown in FIG. 2, so as to have a larger diameter at one face of body portion 120 than at the other, also for a purpose to be described hereinafter.

Ball marker 106 comprises a generally disk-shaped button 130 and a nipple 132 extending perpendicularly from one surface thereof. Nipple 132 is removably snap fit into aperture 128 with button 130 bearing against the smaller-diameter side. Thus, the enlarged end of nipple 132 is housed in the larger-diameter side of aperture 128. The slits in aperture 128 permit nipple 132 to be inserted into the smaller-diameter side, while the reduced diameter itself prevents nipple 132 from falling out when tool 100 is struck by a golf club during teeing off.

Preferably, tool 100 is made of a plastic material which is flexible, light weight, and durable. The overall height of tool 100 is 2¼ inches, while the height of tee cup 110 is ¼ inch, the height of shaft 112 is ¼ inch, the height of body portion 120 is ⅝ inch, and the height of prongs 122 is 1⅛ inches. Tee cup 110 is ½ inch in diameter, shaft 112 is ¼ inch in diameter, body portion 120 is ¾ inch at its widest point, and prongs 122 are ⅛ inch wide adjacent their bottom. Prongs 122 are separated by a distance of ½ inch. Green repair portion 104 is ⅛ inch thick, excluding Should be understood that these dimensions are approximate and are only illustrative, and that tool 100 can be made in accordance with other dimensions. For example, the overall height of tool 100 can be decreased for use with a driver.

In use, the various parts of tool 100 are used in conventional fashion, tee cup 110 being used to support the golf ball, green repair portion 112 being used to repair ball, ball marker, and tee marks on the green surface, and ball marker 106 being used to mark the position of the ball. Prongs 122 of green repair portion 104 also are used to hold tool 100 in place when tee cup 110 is being used.

Figure 4:
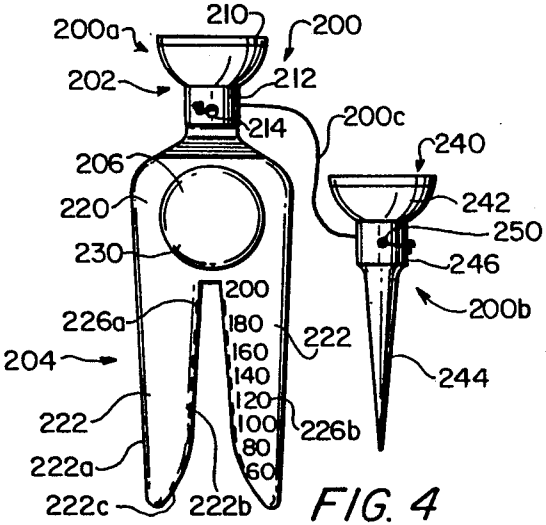
FIG. 4 is a front elevational view of a second embodiment of a tool in accordance with the invention.
Figure 5:
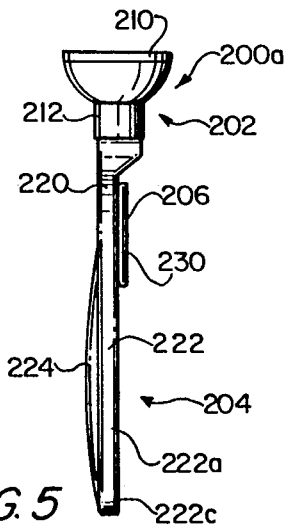
FIG. 5 is a side elevational view of the tool of FIG. 4.
Figure 6:
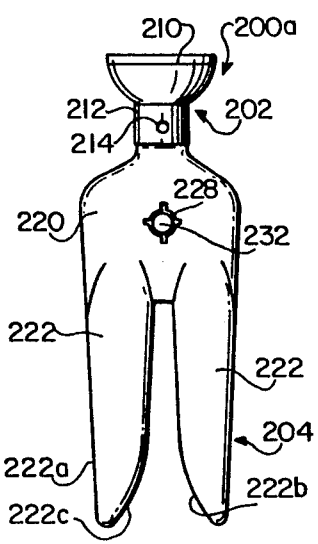
FIG. 6 is a rear elevational view of the tool of FIG. 4.

Referring now to FIGS. 4 through 6, there is shown a second embodiment of a combination golf tool 200 in accordance with the present invention. Tool 200 comprises first and second members **200*a* and 200*b* connected by a cord 200*c*. First member 200*a* comprises an upper tee portion 202, a lower green repair and range finding portion 204, and a ball marker 206 removably incorporated into green repair and range finding portion 204. Tee portion 202 comprises a tee cup 210 and shaft 212 identical to tee cup 110 and shaft 112, except that shaft 212 is provided with an aperture 214 therethrough for attachment of cord 200*c***.

Green repair and range finding portion 204 comprises an upper body portion 220 adjacent shaft 212 and a pair of prongs or legs 222 extending downwardly from body portion 220. Prongs 222 are substantially linear at their outer edges **222*a* and are curvilinear at their inner edges 222*b*, the ends 222*c* being tapered. Prongs 222 are symmetric about the longitudinal axis of member 200*a*. Ends 222*c* are sufficiently tapered to enable tool 200 to be easily inserted into the ground, but sufficiently rounded to avoid injury to the golfer when being handled or when placed in a clothing pocket. Prongs 222 can be provided on one face with convex protrusions 224 similar to protrusions 124**.

The shape of curvilinear edges **222*b* is in part determined by the range-finding function of green repair and range finding portion 204. Edges 222*b* are provided with sets of marks 226*a* at fixed vertical intervals and number 226*b* indicating range associated with each set of marks 226*a*. Marks 226*a* and numbers 226*b* are provided on the face of prongs 222 opposite protrusions 224**, so as to be placed on a flat surface.

As set forth in my copending U.S. application Ser. No. 07/739,208, filed Aug. 1, 1991, which is incorporated herein by reference in its entirety, the ratio of two sides of similar triangles can be used to approximate the distance between the tee and the flag. The pin height "p", is known, as is "s", the separation between each set of marks **226*a* on edges 222*b*, and "d", the optical path length, i.e., the distance between member 200*a* and the retina of the user, which is fixed by the length of cord 200*c*. To this end, it is noted that cord 200*c*** must be substantially inelastic, i.e. not capable of being stretched.

Based upon the well known principle of similar triangles, the ratio of the separation "s" between edges **222*b* at an given set of marks 226*a* (which is equal to the apparent height of the pin when viewed from a distance by the golfer) to the optical path length "d" is equal to the ratio of the actual pin height "p" to the range "R". Thus, for any set of marks 226*a***:

$$R=(d\times p)/s$$

The ranges "R" thus computed are marked as the numbers **226*b* adjacent the corresponding marks 226*a*. When the apparent pin height is matched to one of the sets of marks 226*a***, the golfer knows the approximate range from his or her location to the flag.

An aperture 228 identical to aperture 128 is formed centrally in body portion 220 for attaching ball marker 206 to body portion 220. Ball marker 206 is identical to ball marker 6, comprising a generally disk-shaped button 230 and a nipple 232 which is removably snap fit into aperture 228 with button 230 bearing against the smaller-diameter side of aperture 228.

Second member **200*b* comprises a tee 240 having a conventional tee cup 242 for holding a golf ball, a conventional tapered pin 244 for inserting tee 240 into the ground, and a substantially cylindrical shaft 246 intermediate cup 242 and pin 244. Shaft 246 physically provides a gauge for inserting tee 240 into the ground at the proper height. An aperture 250 is provided through shaft 246 for attachment of cord 200*c*. "Second member 200*b* provides a different tee height than first member 200*a***. One of the first and second members has a tee height appropriate for use with a driver and the other has a tee height appropriate for use with clubs other than a driver."

Preferably, member **200*a* is made of a plastic material which is flexible, light weight, and durable. Member 200*b* can be made of the same plastic material as member 200*a*, or any other durable material conventionally used for golf tees. Cord 200*c*** can be made of any suitable material which is substantially inelastic.

The overall height of member **200*a* is 2¼ inches, while the height of tee cup 21 is ¼ inch, the height of shaft 212 is ¼ inch the height of body portion is ⅝ inch the height of prongs 222 is 1⅛ inches. Tee cup 210 is ½ inch in diameter, shaft 212 is ¼ inch in diameter, and body portion 220 is ¾ inch at its widest point. Green repair and range finding portion 204 is ⅛ inch thick, excluding protrusions 224. Button 230 is ½ inch in diameter. The overall height of member 200*b* is 1½ inches, with tee cup 242 ¼ inch high and ½ inch in diameter, and shaft 246 ¼ inch high and ¼ inch in diameter. It should be understood that these dimensions are approximate and are only illustrative, and that tool 200** can be made in accordance with other dimensions.

In use, the various parts of tool 200 are used in conventional fashion, tee cups 210 and 242 being used to support the golf ball, green repair and range finding portion 204 being used to repair ball, ball marker, and tee marks on the green surface, and ball marker 206 being used to mark the position of the ball. Prongs 222 of green repair and range finding portion 204 also are used to hold member **200*a* in place when tee cup 210** is being used.

For the range finding function, member **200*b* is held adjacent the golfer's forehead at eyebrow level, and cord 200c is extended its full length, with member 200a held in a vertical plane with its longitudinal axis parallel to the horizon and green repair and range finding portion 204 even with the golfer's eyes. The apparent height of the pin is then matched to the separation between one of the sets of marks 226a and the corresponding range number 226b** is read.

Figure 9:
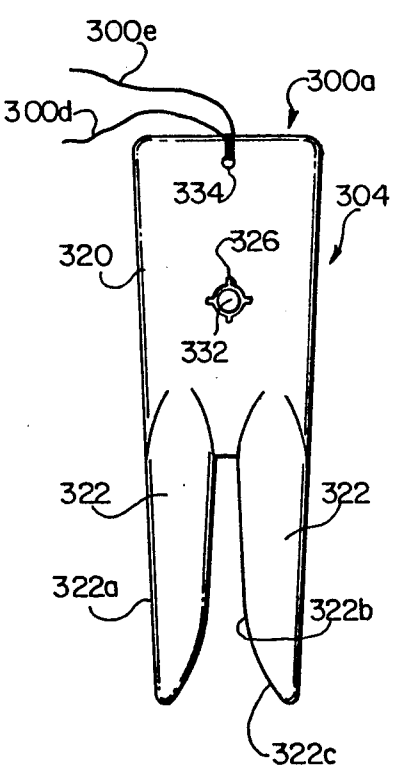
FIG. 9 is a rear elevational view of the tool of FIG. 7.
Figure 8:
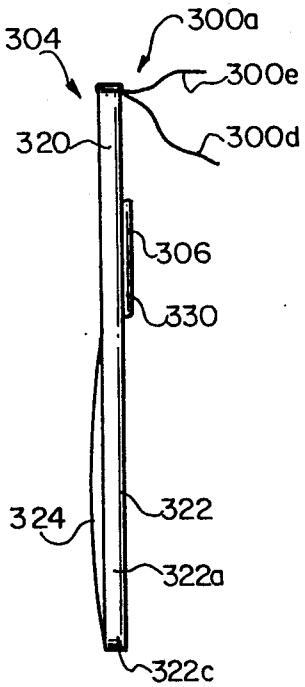
FIG. 8 is a side elevational view of the tool of FIG. 7.
Figure 7:
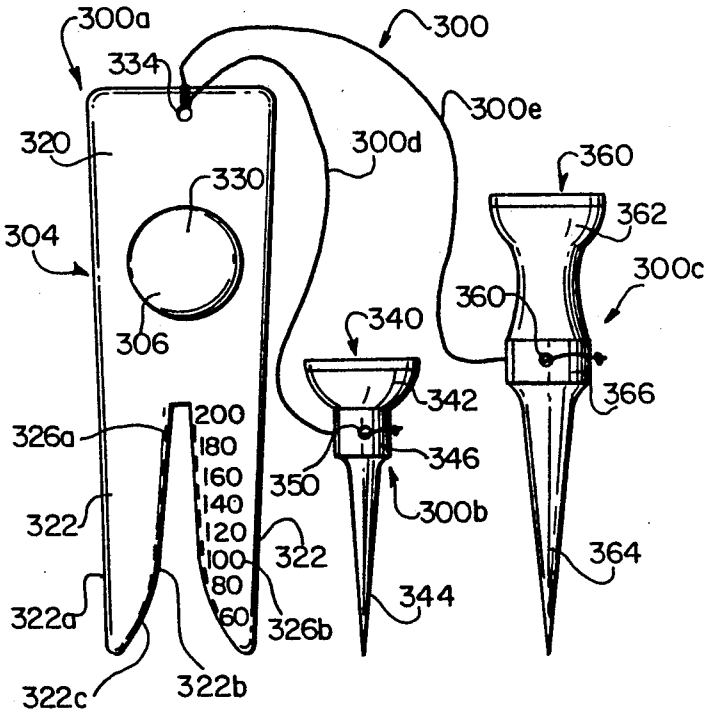
FIG. 7 is a front elevational view of a third embodiment of a golf tool in accordance with the invention.

Referring now to FIGS. 7 through 9, there is shown a third embodiment of a combination golf tool 300 in accordance with the present invention. Tool 300 comprises a first member 300a connected to second and third members 300b and 300c by first and second cords 300d and 300e, respectively. First member 300a comprises a green repair and range finding portion 304 and a ball marker 306 removably incorporated into green repair and range finding portion 304.

Green repair and range finding portion 304 comprises an upper body portion 320 and a pair of prongs or legs 322 extending downwardly from body portion 320. Prongs 322 have substantially the same configuration as prongs 222, being substantially linear at their outer edges 322a, curvilinear at their inner edges 322b, tapered at the ends 322c, and symmetric about the longitudinal axis of member 300a. Prongs 322 can be provided with convex protrusions 324 similar to protrusions 124 and 224.

The shape of curvilinear edges 322b is determined in the same way as the shape of edges 222b in order to be usable for range-finding. Each of edges 322b is provided with marks 326a and range numbers 326b at fixed vertical intervals in accordance with the formula:

$$R=(d\times p)/s$$

as set forth above with respect to member 200b.

An aperture 328 identical to apertures 128 and 228 is formed centrally in body portion 320 for removably attaching ball marker 306 to body portion 320. Ball marker 306 is identical to ball markers 106 and 206, comprising a generally disk-shaped button 330 and a nipple 332 which is snap fit into aperture 328 with button 330 bearing against the smaller-diameter side of aperture 328. An aperture 334 is provided at the top of body portion 320 for attaching cords 300d and 300e.

Second member 300b is substantially identical to second member 200b, comprising a tee 340 having a conventional tee cup 342 for holding a golf ball, a conventional tapered pin 344 for inserting tee 340 into the ground, and a substantially cylindrical shaft 346 intermediate cup 342 and pin 344. An aperture 350 is provided through shaft 346 for attachment of cord 300d. Tee 340 is the proper height for use with clubs other than a driver.

Third member 300c comprises a tee 360 having a tee cup 362 with an hour-glass profile for holding a golf ball, a conventional tapered pin 364 for inserting tee 360 into the ground, and a substantially cylindrical shaft 366 intermediate cup 362 and pin 364. An aperture 360 is provided through shaft 366 for attachment of cord 300e. Tee 360 is the proper height for use with a driver.

Preferably, member 300a is made of a plastic material which is flexible, light weight, and durable. Members 300b and 300c can be made of the same plastic material as member 300a, or any other durable material conventionally used for golf tees. Cords 300d and 300e can be made of any suitable material which is substantially inelastic.

The overall height of member 300a is 2½ inches, while the height of body portion 320 is 1⅜ inches and the height of prongs 322 is 1⅛ inches. Green repair and range finding portion 304 is ⅛ inch thick, excluding protrusions 324. Button 330 is ½ inch in diameter. The overall height of member 300b is 1½ inches, with tee cup 342 ¼ inch high and ½ inch in diameter, and shaft 346 ¼ inch high and ¼ inch in diameter. The overall height of member 300c is 2 inches. It should be understood that these dimensions are approximate and are only illustrative, and that tool 300 can be made in accordance with other dimensions.

In use, the various parts of tool 300 are used in conventional fashion, green repair and range finding portion 304 being used to repair ball, ball marker, and tee marks on the green surface, ball marker 306 being used to mark the position of the ball, and tees 340 and 360 being used to support a golf ball for driving with clubs other than a driver, and with a driver, respectively.

For the range finding function, member 300a is employed in the same fashion as member 200a, either of tees 340 and 360 being used to set the distance of member 300a from the golfer's eyes.

Modifications and variations of the above-described embodiments of the present invention are possible, as appreciated by those skilled in the art in light of the above teachings. For example, tool 100 can be provided with a tee 240 for use with clubs other than a driver.

It is therefore to be understood that, within the scope of the appended claims and their equivalents, the invention may be practiced otherwise than as specifically described.

What is claimed is:

1. A golf tool comprising:

an upper tee portion including a tee cup;

a lower green repair portion including a pair of prongs and a body portion intermediate said upper tee portion and said pair of prongs, said pair of prongs extending downwardly from said body portion, and said prongs each having an inner edge and an outer edge, wherein said inner edges of said prongs comprise range-finding means for determining the distance between a golfer holding said tool and a pin of known height;

a ball marker removably attached to said body portion; and a positioning means for aiding the golfer to position said range-finding means a predetermined distance from the eyes of the golfer.

2. The golf tool of claim 1, wherein said positioning means comprises a golf tee and a cord having a first end attached to said golf tee and a second end attached to said tee portion.

3. The golf tool of claim 1, further comprising a golf tee and a cord, said cord having a first end attached to said golf tee and a second end attached to said upper tee portion, wherein said upper tee portion and said green repair portion define a first member and said golf tee defines a second member, and wherein one of said first and second members has a tee height appropriate for use with a driver and the other of said first and second members has a tee height appropriate for use with clubs other than a driver.

4. A golf tool comprising:

an upper tee portion including a tee cup;

a lower green repair portion including a pair of prongs and a body portion intermediate said upper tee portion and said pair of prongs, said pair of prongs extending downwardly from said body portion, and said prongs each having an inner edge and an outer edge, wherein said inner edges of said prongs comprise range-finding means for determining the distance between a golfer holding said tool and a pin of known height;

a ball marker removably attached to said body portion; and a positioning means for positioning said range-finding means a predetermined distance from the eyes of the golfer;

wherein said inner edges have a curvilinear configuration and a plurality of sets of marks thereon, and wherein said configuration and the location of said sets of marks is determined by the formula:

$$R=(d\times p)/s,$$

where "R" is the range associated with each of said sets of marks, "p" is the pin height, "s" is the separation between said inner edges at each of said set of marks, and "d" is said predetermined distance between said range-finding means and the eyes of the golfer.

* * * * *